United States Patent [19]

Colquitt

[11] Patent Number: 4,830,198

[45] Date of Patent: May 16, 1989

[54] AIRBRUSH HOLDER

[76] Inventor: Albert D. Colquitt, #6 Rancho Verde Ct., Sacramento, Calif. 95828

[21] Appl. No.: 184,418

[22] Filed: Apr. 21, 1988

[51] Int. Cl.[4] ..... A47F 7/00

[52] U.S. Cl. ..... 211/706; 211/13

[58] Field of Search ..... 211/70.6, 70.7, 60.1, 211/13; 248/37.6; 269/16

[56] References Cited

U.S. PATENT DOCUMENTS

| | | | |
|---|---|---|---|
| D. 199,321 | 10/1964 | Peterson | 211/70.7 X |
| 2,754,008 | 7/1956 | Culver | 211/70.6 X |
| 2,855,107 | 10/1958 | Roth | 211/70.6 |
| 4,071,212 | 1/1978 | Burrows et al. | 211/70.7 X |

FOREIGN PATENT DOCUMENTS

| | | | |
|---|---|---|---|
| 1084875 | 1/1955 | France | 211/70.7 |

*Primary Examiner*—Reinaldo P. Machado
*Assistant Examiner*—Sarah A. Lechok Eley

[57] ABSTRACT

The invention provides a one-piece holder sized and shaped to support and maintain an artist's airbrush substantially horizontally positioned with the holder attached to a vertical surface and with the holder attached to a horizontal surface. The holder is U-shaped with angled supports arranged to form opposing support structures sized, slotted, and apertured to be useful as a repository for a variety of artist-type airbrushes. The airbrush holder is attachable to a table by a separate base plate and a jaw clamp. A mounting plate for vertical screw attachment to a wall in a work area is provided in angled support plates included in the one-piece holder structure. In a second embodiment, the mounting plate is angled back under the U-shaped holder for screw mounting to a horizontal surface.

2 Claims, 2 Drawing Sheets

AIRBRUSH HOLDER

BACKGROUND OF THE INVENTION

1. Field of the Invention

This invention relates to holders designed as a resting appliances for artist-type airbrushes. The present invention is particularly directed at a multi-use holder designed for wall mounting or as a desk fixture.

2. Description of the Prior Art

Airbrush holders are not abundantly disclosed in past-art holder-type patents. Most holders of a type having any similarity to the present invention are for pens, pencils, glue machines, or drafting tools. A search of Patent Office files produced the following:

U.S. Pat. No. 1,540,959, dated June 9, 1925, issued to Schumacker for a curling iron holder. A wall bracket holder is described.

The Jewell patent of Oct. 12, 1926, U.S. Pat. No. 1,602,493, is for a pen holder on a stand base.

A patent issued to Williams, U.S. Pat. No. 1,780,546, shows a type of fountain pen holder in an openable clip. The patent dated Nov. 4, 1930.

U.S. Pat. No. 2,693,788, shows a magnet desk pen set. The patent is dated Nov. 9, 1954, and was issued to Spatz.

A wall bracket is described in the Fisher U.S. Pat. No. 3,263,952, dated Aug. 2, 1966.

In U.S. Pat. No. 3,866,756, we again see a pen stand. The patent shows Moore et al as the recipient and the patent is dated Feb. 18, 1975.

On June 8, 1982, a patent issued to May, U.S. Pat. No. 4,333,623, depicts the use of an angled frame structure as a glue gun holder.

And the Coronado patent issued Mar. 12, 1985, U.S. Pat. No. 4,503,891, is an example of drafting tool support structures.

With the possible exception of the May device, which involves an angled support frame structured considerably different in design and use from my holder, I found no similarities in other seen past-art patents.

SUMMARY OF THE INVENTION

In practicing my invention, I have developed a holder specifically for artist-type airbrushes structured out of one continuous material piece. The single-piece holder is angled to form the necessary airbrush support features and apertured with retainer fixtures to rest the airbrush in with or without the paint supply container.

Therefore, it is a primary object of my invention to provide an artist-type airbrush container formed from a single piece of continuous material.

Another object of the invention is to provide a single-piece airbrush holder which has movable deskclamping features and the same holder can be used as a wall-mount fixture.

A further object of my invention is to provide an airbrush holder with multiple repositories for airbrushes with or without the paint supply container attached.

A still further object of the invention is to provide different models of a continuous one-piece airbrush holder design which can be used with the air hose attached to the airbrush in a variety of useful locations.

Other objects and the many advantages of my invention will become obvious with a reading of the specification and comparing the described numbered parts with similarly numbered parts shown on the included drawings

DESCRIPTION OF THE PREFERRED EMBODIMENTS

Figure 1:
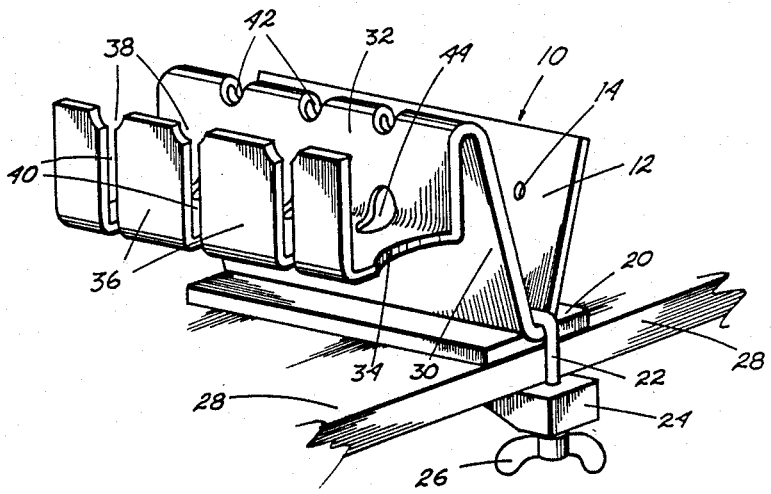
FIG. 1 is a perspective view of the preferred embodiment of the airbrush holder with the holder clamped to a work surface.
Figure 2:
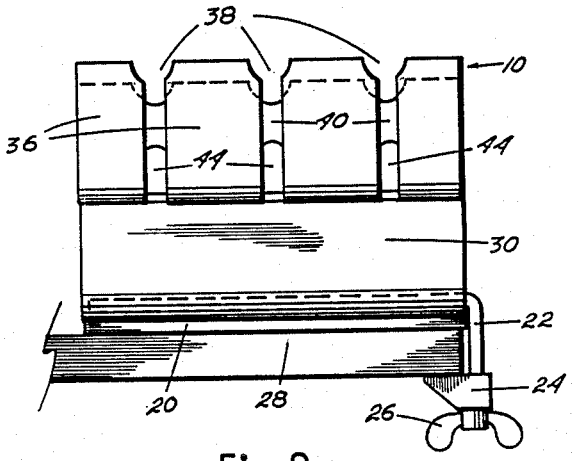
FIG. 2 shows the mounted airbrush holder of FIG. 1 in a frontal view.
Figure 3:
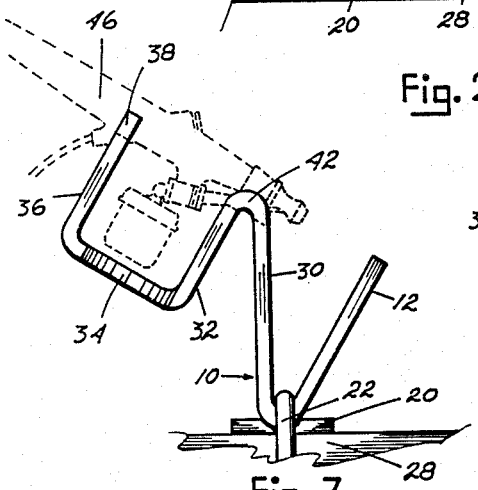
FIG. 3 is a side view of the work surface mounted airbrush holder illustrating the angled sections and indicating the positioning of an artist-type airbrush resting in the holder.

Referring now to the drawings, to the figures, and to the numbered parts. The use of the word "one" with the descriptions indicates the preferred embodiment and the use of "two" indicates reference to an alternate embodiment. At FIG. 1 in the drawings, the preferred embodiment of this invention, airbrush holder one 10, is shown in a perspective view clamped to work surface 28 by pivot clamp rod 22 along pivot base 20. Pivot clamp rod 22 angles downwardly and secures airbrush holder one 10 to work surface 28 by wing nut 26 pressing clamp jaw 24 up against the underside of work surface 28. The airbrush holder supports and apertures include holder support plate 30, nozzle support plate 32, extension plate 34, airbrush support plate 36, airbrush rests 38, airbrush slots 40, upper nozzle rests 42, and lower nozzle rests 44. The listings from 30 to 44 are common to the different embodiments of the present invention and are seen in the various drawing figures. In FIG. 3, airbrush 46 is depicted by dotted lines with the nozzle resting in upper nozzle rests 42, the paint supply container downwardly towards extension plate 34, and the handle positioned in airbrush rests 38 at the top of airbrush support plate 36.

Figure 4:
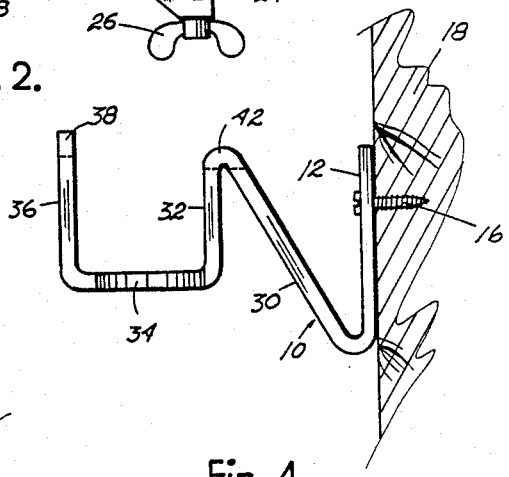
FIG. 4 shows the airbrush holder in a wall-mounted application.

FIG. 4 in the drawings illustrates the embodiment of airbrush holder one 10 mounted to a vertical surface such as wall 18. Wall mount attachment plate 12 is vertically aligned with wall 18 and airbrush holder one 10 is attached by screws 16 through wall-mount apertures 14 (illustrated in FIG. 1).

Figure 5:
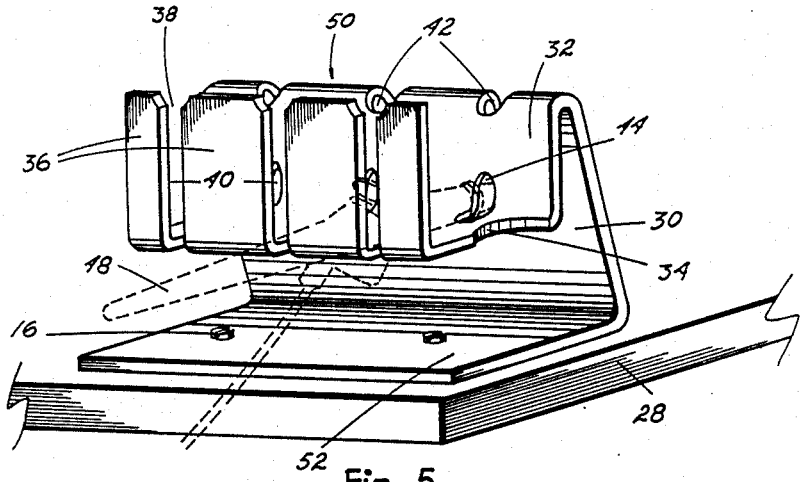
FIG. 5 illustrates an alternate embodiment of the invention in a perspective view mounted to a work surface by screws and indicating an artist-type airbrush at rest in the holder.
Figure 6:
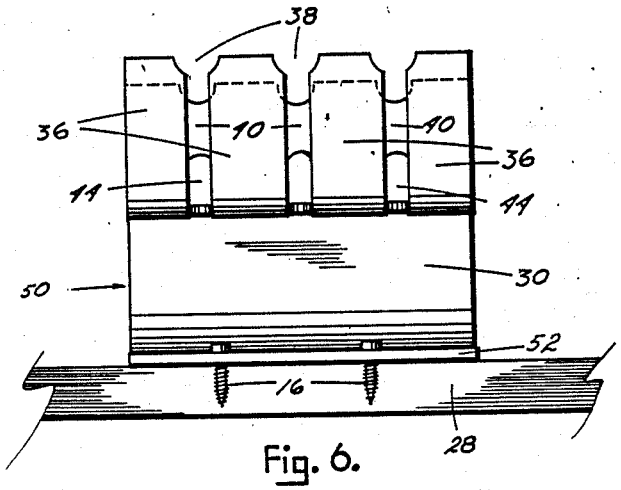
FIG. 6 is a frontal view of FIG. 5 with the work surface frontal section opened to illustrate the use of screws for holder mounting.
Figure 7:
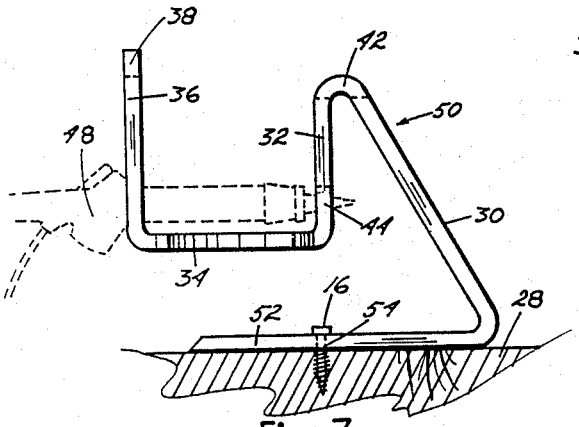
FIG. 7 is a side view of the FIG. 5 embodiment illustrating the holder shaped from one continuous material piece and the use of mounting screws.
Figure 8:
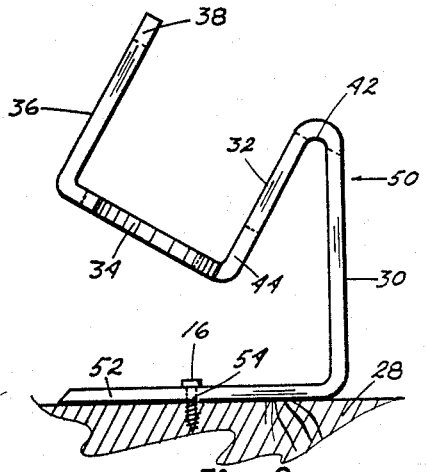
FIG. 8 is a side view of the airbrush holder of the FIG. 5 embodiment illustrating the frontal support U-frame in an angled position.

In FIG. 5, alternate embodiment, airbrush holder two 50 is illustrated in a perspective view. Parts as previously described and common to the various embodiments are numbered and shown in FIGS. 5, 6, 7, and 8. The principal difference between the two described embodiments is the reverse angle of work surface base plate 52 which is screw-attached to work surface 28 by screws 16 through work surface apertures 54. The reverse angle of work surface base plate 52 can be seen best in FIG. 7. FIG. 8 illustrates airbrush holder two 50 with the U-support formed by nozzle support plate 32, extension plate 34, and airbrush support plate 36 positioned at an angle. A slim sized airbrush 48 is depicted in FIG. 5 and in FIG. 7 downwardly positioned. A standard airbrush as illustrated in FIG. 3 would set in airbrush rests 38 with the nozzle rested on nozzle support plate 32 or would be angled with the nozzle downward inserted into lower nozzle rests 44 which are oval apertures. The invention provides a simple and practical airbrush holder which can be mounted securely to a table, a desk top work surface, or can be attached to a wall handy to a work area.

Although I have described embodiments of my invention with details in the specification, it is to be understood that modifications in the design and structure of the invention may be practiced which do not depart from the intent of the scope of the appended claims.

What is claimed is:

1. A one-piece holder sized and shaped to support and maintain an artist's airbrush substantially horizontally positioned with said holder attached to a horizontal surface or with said holder attached to a vertical surface, comprising:

a substantially rectangular U-shaped member with an angled support structure, said U-shaped member opened upwardly with a first vertical wall terminating upwardly, said first vertical wall forming downwardly along a rounded right angled edge into a horizontally aligned extension plate, said extension plate being the bottom of said U, said extension plate continuing by a rounded right angled curve upwardly into a second vertical wall equal in height to said first vertical wall, said second vertical wall upwardly continuing in a rolled edge curved downwardly forming into a holder support plate angled away from and somewhat wider than said second vertical wall with said holder support plate continuing in a rolled edged curved upwardly forming into a wall mount attachment plate angled away from said holder support plate and forming said angled support structure therewith, said wall mount attachment plate terminating upwardly equal in height to said first vertical wall and said second vertical wall, the upwardly terminal edges of said walls and said wall mount attachment plate in parallel alignment to each other;

said first vertical wall cut full width by spaced vertical slots sized for passage therethrough of artist airbrush air supply hoses, said spaced vertical slots having the upper edges rounded into airbrush sized rests and the lower edges cut and rounded somewhat back into said extension plate, there being spaced apertures aligning said extension plate along said upwardly rounded right angled curve and somewhat into said second vertical wall and half circle openings of folded spaced apertures aligned in said second vertical wall along said upwardly rolled edge thereof; said apertures registering with said slots in said first vertical wall for said supporting of said artist's airbrush;

said wall mount attachment plate apertured for screw mounting to a vertical support surface and, for horizontal mounting, there being a detached substantially rectangular flat base longitudinally centrally grooved to accept said rolled edge attachment between said holder support plate and said wall mount attachment plate adjustable retained therein by a pivot clamp rod, said pivot clamp rod having a right angled end thereof threaded, said pivot clamp rod positioned longitudinally in said rolled edge and retained there by a clamp jaw under the edge of horizontal work surface keeping said holder temporarily attached to said surface by said jaw fitting said threaded end of said clamp rod and locked thereon by a twist lock in the nature of a wing nut.

2. A one-piece holder sized and shaped to support and maintain an artist's airbrush substantially horizontally positioned with said holder attached to a horizontal surface, comprising:

a substantially rectangular U-shaped member with angled support structure, said U-shaped member opened upwardly with a first vertical wall terminating upwardly, said first vertical wall forming downwardly along a rounded right angled edge into a horizontally aligned extension plate, said extension plate being the bottom of said U, said extension plate continuing at a rounded right angled curve upwardly into a second vertical wall equal in height to said first vertical wall, said second vertical wall upwardly continuing in a rolled edge curved downwardly forming into a holder support plate angled away from and somewhat wider than said second vertical wall with said holder support plate continuing in a rolled edge curved at right angles back towards and under said U-shaped member forming said angled support structure and a work surface base plate, there being apertures in said work surface base plate for screw attachment to a horizontal surface;

said first vertical wall cut full width by spaced vertical slots sized for passage therethrough of artist airbrush air supply hoses, said spaced vertical slots having the upper edges rounded into airbrush sized rests and the lower edges cut back and rounded somewhat into said extension plate, there being spaced apertures aligning said extension plate along said upwardly rounded right angled curve somewhat into said second vertical wall and half circle openings of folded spaced apertures aligned in said second vertical wall along said upwardly rolled edge thereof; said apertures registering with said slots in said first vertical wall for said supporting of said artist's airbrush.

* * * * *